United States Patent [19]

Valent et al.

[11] 4,165,707

[45] Aug. 28, 1979

[54] HIGH LATERAL LOAD CAPACITY, FREE-FALL DEADWEIGHT ANCHOR

[75] Inventors: Philip J. Valent; John M. Atturio, both of Ventura; Robert D. Rail, Ojai, all of Calif.

[73] Assignee: The United States of America as represented by the Secretary of the Navy, Washington, D.C.

[21] Appl. No.: 867,631

[22] Filed: Jan. 9, 1978

[51] Int. Cl.[2] ..... B63B 21/24; B63B 21/27; B63B 21/29

[52] U.S. Cl. ..... 114/300; 114/294

[58] Field of Search ..... 114/294, 300, 243, 293, 114/311, 296; 52/166

[56] References Cited

U.S. PATENT DOCUMENTS

| | | | |
|---|---|---|---|
| 189,601 | 4/1877 | Buck | 114/300 |
| 2,464,661 | 3/1949 | Woodland | 114/300 |
| 2,556,279 | 6/1951 | Johnson | 114/294 |
| 3,187,705 | 6/1965 | Costello | 114/294 |
| 3,472,196 | 10/1969 | Ewing | 114/243 |
| 3,975,980 | 8/1976 | Hood | 114/243 |

*Primary Examiner*—Trygve M. Blix
*Assistant Examiner*—D. W. Keen
*Attorney, Agent, or Firm*—Richard S. Sciascia; J. M. St.Amand; Darrell E. Hollis

[57] ABSTRACT

A high lateral load capacity, free-fall, deadweight anchor comprising a flat plate having a lip attached to its periphery to eliminate skating during free-fall; a wire mesh screen attached to the lip to control vortex shedding such that the flat plate maintains an upright posture during free-fall; and a plurality of shear keys attached to the underside of the plate which imparts a high lateral load capability to the anchor.

16 Claims, 6 Drawing Figures

HIGH LATERAL LOAD CAPACITY, FREE-FALL DEADWEIGHT ANCHOR

BACKGROUND OF THE INVENTION

1. Field of the Invention

This invention relates generally to anchors and more particularly to high lateral-load capacity, free-fall, deadweight anchors.

2. Description of the Prior Art

With the development of ocean thermal energy conversion power plants, a need has developed for anchor systems capable of resisting lateral loads of one million pounds and greater in water depths of fifteen hundred feet and greater. Drag embedment and embedded plate type anchors of the size required to achieve the required lateral loads are not technically feasible. Pile type anchors are inefficient for most seafloor environments. In fact, there are no known prior art anchor systems capable of resisting lateral loads in excess of one million pounds in water depths in excess of fifteen hundred feet.

SUMMARY OF THE INVENTION

The present invention provides an anchor system capable of resisting lateral loads in excess of one million pounds in water depths of greater than fifteen hundred feet by providing a hydrodynamically stable, deadweight, free-fall anchor having integral fixed appendages for providing high lateral load capacity. The anchor of the present invention comprises a flat plate having a lip attached to its periphery for eliminating skating during free-fall; a wire mesh screen attached to the lip for controlling vortex shedding such that the flat plate maintains an upright posture during free-fall; and a plurality of shear keys attached to the underside of the plate which imparts a high lateral load capacity to the anchor.

Accordingly, one object of the present invention is to provide an anchor having high lateral load capacity while maintaining a high mooring line angle.

Another object of the present invention is to provide an anchor system capable of being installed in a free-fall mode without the requirement for an on-site heavy load lowering capability.

Another object of the present invention is to provide an anchor system capable of stable free-fall in a body of water, i.e., free from rotational instability and substantially free from pitching instability.

A further object of the present invention is to provide an anchor system possessing a moderate free-fall terminal velocity for minimizing deceleration forces on landing.

A still further object of the present invention is to provide an anchor system with sufficient structural strength to maintain structural integrity on impact with unconsolidated seafloors.

Other objects and further scope of applicability of the present invention will become apparent from the detailed description given hereinafter. The detailed description indicates the preferred embodiments of the invention and is given by way of illustration only, since various changes and modifications in the spirit and scope will become apparent to those skilled in the art from this detailed description when considered in connection with the accompanying drawings in which like reference numerals designate like parts throughout the figures thereof and wherein.

It should be understood that the foregoing abstract of the disclosure is for the purpose of providing a non-legal brief statement to serve as a search scanning tool for scientists, engineers, and researchers, and is not intended to limit the scope of the invention as disclosed herein nor is it intended that it should be used in interpreting or anyway limiting the scope or fair meaning of the appended claims.

DETAILED DESCRIPTION OF THE PREFERRED EMBODIMENT

Figure 1:
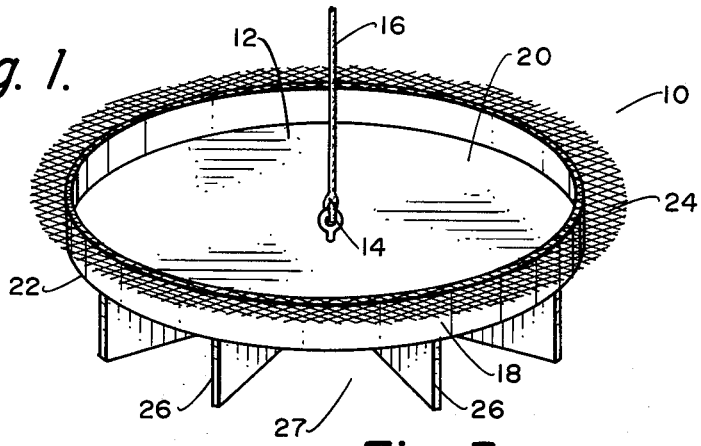
FIG. 1 is an isometric view of a preferred embodiment of the present invention.

FIG. 1 is an isometric illustration of an embodiment 10 of the present invention. The anchor system 10 comprises a substantially flat plate 12 with mooring line 16 attached to the center 14 thereof. Plate 12 has an upright side 20 and an underside 22. The plate 12 shown in FIG. 1 is circular in shape.

A lip is rigidly connected to plate 12 about it periphery extending upwards from the upright side 20 of plate 12. Lip 18 is disposed substantially vertical with respect to the surface of side 20 of plate 12 extending upwards therefrom a distance of approximately one-tenth of the diameter of plate 12. Fairing or lip 18 functions to stabilize the side slip or skating motion of plate 12 thereby maintaining a downward movement of plate 12 within a substantially vertical column of water during free-fall of the anchor 10.

Attached to the top edge of lip or fairing 18 is a wire mesh screen 24 which extends outwards from lip or fairing 18 in a plane substantially parallel to the plane of the surface of side 20 of plate 12. Screen 24 provides vortex shedding control and added drag force during free-fall of anchor 10 within a substantially vertical column of water which limits the pitching of anchor 10 such that anchor 10 maintains an upright position during free-fall until it comes to rest upon the ocean bottom. It is noted that the anchor 10 is shown in its upright position in FIG. 1.

Figure 5:
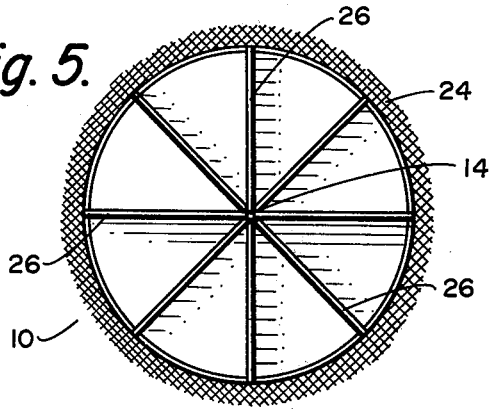
FIG. 5 is a bottom view of the embodiment of FIG. 1.

A plurality of shear keys 26 are attached to surface of side 22 of plate 12 extending downwards therefrom. Shear keys 26 extend outward radially from center 14 of plate 12 to the periphery of plate 12 and are disposed substantially vertical to side 22 of plate 12. These radially extending vanes or skear keys 26 are shown in FIG. 5 which is a bottom view of the embodiment 10. The shear keys 26 provide lateral load resistance by embedding in the soil of the seafloor and forcing the potential soil failure surface down into deeper, more competent soil layers and by possessing sufficient structural strength such that they are not bent or broken away from anchor plate 12 under maximum lateral loading. The openings 27 allow for easy egress of water trapped between the surface 22 and the seafloor during the last seconds of free-fall. If this water were not allowed to egress during the last few seconds of free-fall, undesirable skating of anchor 10 could occur and result in an incomplete seating of anchor shear keys 26 within the seafloor.

It is noted that the embodiment shown in FIG. 1 as well as those shown in FIGS. 2, 3, 4, 5, and 6, are capable of resisting lateral loads of one million pounds to 40 million pounds in water depths of fifteen hundred feet and more. It is further noted that the vertical height of shear keys 26 will vary with the composition of the soil and the seafloor. For instance, it has been found that the vertical height of the shear keys 26 exhibit efficient operation on clay soil composition when the vertical height of shear keys 26 is approximately one-tenth of the diameter of flat plate 12.

Figure 2:
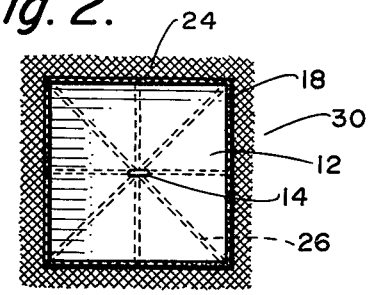
FIG. 2 is a top view of another embodiment of the present invention.

FIG. 2 illustrates an alternative embodiment 30 with flat plate 12 being square in shape whereas flat plate 12 of FIG. 1 is circular in shape. It is noted that lip 18 and screen mesh 24 are square to comport with the square shape of plate 12 in FIG. 2. Radial vanes 26 extend radially outward from the center 14 to the periphery of square plate 12.

Figure 3:
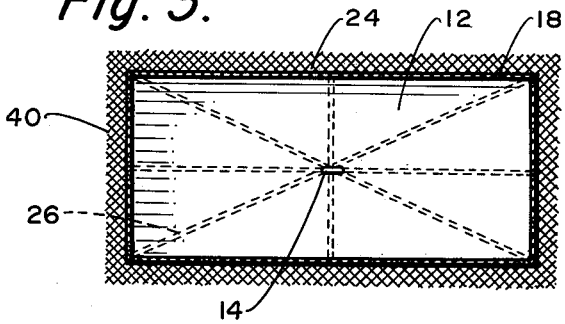
FIG. 3 is a top view of another embodiment of the present invention.

FIG. 3 is a top view of an alternative embodiment of the present invention. The flat plate 12 is rectangular in shape with lip 18 and wire mesh 24 also being rectangular in shape to comport with the rectangular shape of plate 12. Radial vanes 26 extend radially outward from the center 14 of rectangular flat plate 12 to the periphery of plate 12.

Figure 4:
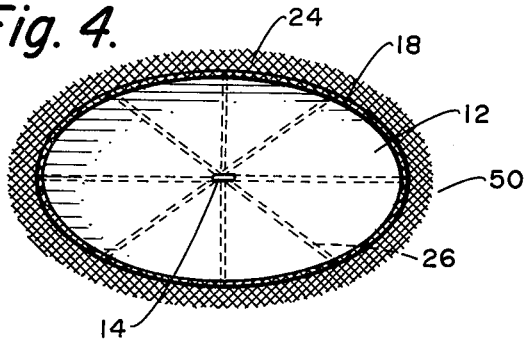
FIG. 4 is a top view of another embodiment of the present invention.

FIG. 4 illustrates a top view of still another embodiment of the present invention. An oblong flat plate 12 is utilized in place of the circular flat plate 12 shown in FIG. 1. Oblong shaped wire mesh 24 and lip or fairing 18 are also provided to comport with the oblong shape of flat plate 12 in FIG. 4. Radial shear keys 26 are also shown extending radially outward from center 14 of oblong flat plate 12. It is noted that the shear keys 26 shown in the embodiments of FIGS. 1–5 may extend downward from plate 12 approximately ten percent of the length of the longest straight line that may be inscribed in plate 12.

Figure 6:
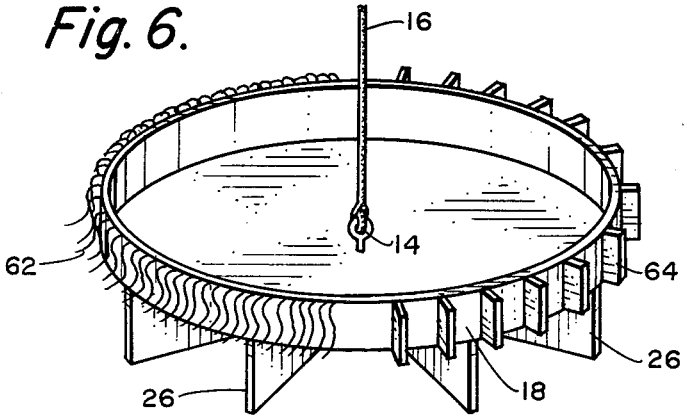
FIG. 6 is an isometric view of another embodiment of the present invention.

FIG. 6 illustrates another embodiment of the present invention. The embodiment shown in FIG. 6 is identical to that shown in FIG. 1 with the exception that the embodiment of FIG. 6 does not include the wire mesh screen 24 for providing vortex shedding control. The embodiment of FIG. 6 provides vortex shedding control by means of flexible projections 62 attached to the outside surface of lip 18 or thin rigid projections 64 also attached to the outside of lip 18. Flexible projections 62 include rubber fingers while the rigid projections 64 include fins. It is noted that many such projections are utilized in undersea technology to provide vortex shedding control which would be applicable to Applicant's invention.

It is envisioned that the base plate 12, shear keys 26, and fairing or lip 18 be fabricated from reinforced concrete and/or prestressed concrete or such other material of strength and corrosion resistance capable of withstanding the undersea environment. In addition, it is noted that anchor 10 may be reinforced with steel or other material in those areas that require additional structural strength.

After construction, anchor 10 may be transported to the future anchor site where it is assembly launched or dropped to free-fall to the seafloor surface.

No anchor system is complete without the successful deployment of a mooring line 16. It is envisioned that mooring line 16 may be attached to anchor 10 before its free-fall and either carried down to the seafloor on top of anchor 10 with one end brought back to the surface by a float or paid out from a bale on anchor 10 during free-fall. Alternatively, the mooring line 16 may be attached to the anchor after its landing on the seafloor.

If additional weight is desired to increase the anchor's vertical and/or lateral load capacity, various materials may be placed or fixed to the top of flat plate 12, such as iron ore, pig iron, rock, concrete, barite ore, barite drilling mud and even dredged seafloor soil.

The anchor 10 would need to be modified for use on rock or other hard surface seafloors. In the case of rock seafloors, the lateral load capacity of anchor 10 can be derived from piles or rock anchors passing through plate 12 and penetrating deep into the underlying hard seafloor. The piles or rock anchor rods could be grouted both into the rock and into plate 12 thereby providing a monolithic unit. The free-fall plate 12 then would serve as a pile template.

It is envisioned that an anchor 10 that would resist load components of nine mega newtons (2 million pounds) horizontal and nine mega newtons (2 million pounds) vertical would be on the order of 33 meters in diameter with plate thickness of approximately 1.4 meters and a fairing approximately 3.3 meters high. The shear keys would protrude beneath the plate to a depth of approximately 3.3 meters and would have a thickness of approximately 0.4 meters.

Alternately, a plurality of mooring points can be used in place of a single point 14. Also the rectangular embodiment of FIG. 3 can have fins radiating from two foci (as in an ellipse) rather than from a single center point 14.

Therefore many modifications and embodiments of this specific invention will readily come to mind to one skilled in the art having the benefit of the teachings presented in the foregoing description and the accompanying drawings of the subject invention, and hence it is to be understood that the invention is not limited thereto and that such modifications, etc., are intended to be included within the scope of the appended claims.

What is claimed is:

1. A free-fall, moderate-velocity, deep-water anchor assembly having high lateral loading capacities even when subjected to high mooring line angles comprising:

a. a substantially flat plate member presenting a large surface area to the direction of travel through the water to maintain a moderate rate of fall through the water and to provide a large contact area on the surface of the ocean bottom;

b. a lip attached to the perimeter of said plate member and extending upwards therefrom for maintaining said plate member within a substantially vertical column of water during free-fall of said plate member within said vertical column of water; and c. a plurality of shear keys attached on the underside of said plate member, said shear keys extending radially outward from a common point toward the periphery of said plate and providing lateral load resistance for said anchor assembly.

2. The apparatus of claim 1 further comprising means disposed adjacent said plate member for controlling vortex shedding of said plate member during free-fall in said body of water such that said plate member maintains an upright position during said free-fall.

3. The apparatus of claim 2 wherein said vortex shedding means includes a wire mesh screen disposed adjacent the periphery of said plate member.

4. The apparatus of claim 3 wherein said vortex shedding means includes a plurality of projections disposed adjacent the periphery of said plate member.

5. The apparatus of claim 4 wherein said plurality of projections includes a plurality of fins.

6. The apparatus of claim 4 wherein said plurality of projections includes a plurality of flexible projections.

7. The apparatus of claim 1 wherein said shear keys extend from said common point to the periphery of said plate.

8. The apparatus of claim 1 wherein said lip is rigidly attached to said plate member.

9. The apparatus of claim 1 wherein said lip extends upwards from said plate member a distance approximately equal to one-tenth of the length of the longest straight line that may be inscribed on said plate member.

10. The apparatus of claim 1 wherein said plate member is circular in shape.

11. The apparatus of claim 10 wherein said lip extends upwards from said circular plate member a distance equal to one-tenth the diameter of said circular plate member.

12. The apparatus of claim 1 wherein said plate member is circular in shape.

13. The apparatus of claim 1 wherein said plate member is square in shape.

14. The apparatus of claim 1 wherein said plate member is rectangular in shape.

15. The apparatus of claim 1 wherein said plate member is oblong in shape.

16. The apparatus of claim 1 wherein each said shear key extends downward from the underside of said plate member a distance approximately equal to one-tenth of the longest straight line that may be inscribed on said plate member.

* * * * *